US005705775A

United States Patent [19]

Ishihara et al.

[11] Patent Number: 5,705,775

[45] Date of Patent: Jan. 6, 1998

[54] CORONA CONTROL RING HAVING ELONGATED WATER DISCHARGE HOLES

[75] Inventors: Masamichi Ishihara, Ama-gun; Toshiyuki Nakachi, Inuyama; Shuji Fujii, Komaki, all of Japan

[73] Assignee: NGK Insulators, Ltd., Japan

[21] Appl. No.: 576,769

[22] Filed: Dec. 21, 1995

[30] Foreign Application Priority Data

Dec. 21, 1994 [JP] Japan ..... 6-318595

[51] Int. Cl.[6] ..... H01B 17/42; H01B 17/44

[52] U.S. Cl. ..... 174/140 CR

[58] Field of Search ..... 174/140 CR, 140 R, 174/1, 2, 144, 141 R, 141 C, 140 S, 140 H, 127, 150

[56] References Cited

FOREIGN PATENT DOCUMENTS 7272573 10/1995 Japan .
8031544 2/1996 Japan .

*Primary Examiner*—Kristine L. Kincaid
*Assistant Examiner*—Kamand Cuneo
*Attorney, Agent, or Firm*—Parkhurst, Wendel & Burr, L.L.P.

[57] ABSTRACT

A corona control ring has a corona control ring main body and a water discharge hole having an elongated shape like a racetrack. The corona control ring main body includes a bottom portion and an inner wall portion and an outer wall portion respectively arranged at an inner edge portion and an outer edge portion of the bottom portion. The water discharge hole is arranged in the bottom portion. A depression portion is formed in the corona control ring main body by the inner wall portion, the outer wall portion and the bottom portion. Accordingly, the present invention provides a corona control ring which can suppress a corona discharge even during rain fall.

9 Claims, 5 Drawing Sheets

1

CORONA CONTROL RING HAVING ELONGATED WATER DISCHARGE HOLES

BACKGROUND OF THE INVENTION (1) Field of the Invention

The present invention relates to a corona control ring which is installed along with insulator apparatuses, phase-to-phase spacers or the like for a power-transmission line and is used for reducing corona discharge.

(2) Related Art Statement

Along with insulator apparatuses for insulating power-transmission lines or phase-to-phase spacers used for preventing contact between the power-transmission lines by keeping a distance constant between the power-transmission lines, the corona control ring is sometimes used for preventing corona discharge near metal fittings arranged at both end portions at which an electric field may be concentrated.

As a corona control ring mentioned above, there is known a ring shaped bent metal pipe. However, in this case, it is necessary to bend each pipe individually, and thus productivity decreases. Therefore, generally, use is made of a corona control ring formed by casting a device having a shape shown in FIGS. 8 and 9. In the embodiments shown in FIGS. 8 and 9, a corona control ring main body 22 of a corona control ring 21 has a circular shape in a plan view. A part of the corona control ring main body 22 has a cut out portion. There are also embodiments without a cut out portion. A depression portion 23 is arranged in the corona control ring main body 22 to reduce the weight of the corona control ring 21. Since there is the depression portion 23, the corona control ring main body 22 is "U" shaped in cross section, comprising a bottom portion 24 having an arc shape in cross section 35 and a pair of side wall portions 25 extending upward from the edge portions of the bottom portion 24.

The corona control ring 21 is secured to upper and lower end portions of, for example, a phase-to-phase spacer (not shown) by means of a securing portion 26 extending from the side wall portion 25 of the corona control ring main body 22. The corona control ring 21 is secured to the phase-to-phase spacer such that the depression portion 23 faces upward at an upper end portion as shown in FIG. 8 and downward at a lower end portion. In this case, since the projection portions of the upper and lower corona control rings 21 are arranged face to face, it is possible to suppress corona discharge from the corona control ring 21 itself.

In the embodiment shown in FIG. 8, since the depression portion 23 of the upper corona control ring 21 faces upward, water gathers in the depression portion 23 when there is rain fall. The water gathered in the depression portion 23 tends to corrode the corona control ring main body 22. To eliminate the problem mentioned above, a plurality of water discharge holes 27 each having a small diameter are arranged in the bottom portion 24 of the corona control ring main body 22 to discharge the water therethrough. In the embodiment shown in FIG. 8, four water discharge holes 27 are arranged.

However, if the number of the water discharge holes 27 is only three or four, a total amount of area of the water discharge holes 27 is low compared to the area of the depression portion 23. Therefore, if a rain fall is hard, an amount of water gathered in the depression portion 23 is larger than that of water that can be discharged through the water discharge holes 27, such that water pools in the depression portion 23. In this case, water pooled in the depression portion 23 is gathered at the water discharge holes 27, and is discharged collectively through the water discharge holes 27. The water discharged from the water discharge holes 27 then becomes a projection shape at which an electric field concentrates, and thus corona discharge is liable to be generated. Therefore, noise due to the corona discharge causes signal jamming of television, radio or the like. Moreover, radiation due to the corona discharge is disturbing to nearby inhabitants.

Further, since it is not possible to discharge the water pooled in the depression portion 23 completely by means of the water discharge holes 27 mentioned above, the corona control ring main body 23 tends to corrode.

SUMMARY OF THE INVENTION

It is an object of the present invention to eliminate the drawbacks mentioned above and to provide a corona control ring which can suppress corona discharge even during rain fall.

According to a first aspect of the invention, a corona control ring comprises a corona control ring main body having a tubular shape, comprising a bottom portion and an inner side wall portion and an outer side wall portion respectively arranged at an inner edge portion and an outer edge portion of said bottom portion, and a water discharge hole having a racetrack shape arranged in the bottom portion along an extended direction of the corona control ring main body.

Moreover, according to a second aspect of the invention, a corona control ring comprises a corona control ring main body having a tubular shape, comprising an outer bottom portion and an outer wall portion arranged at an outer edge portion of the outer bottom portion.

In the first aspect of the invention, a depression portion is constructed by means of the inner side wall portion, the outer side wall portion and the bottom portion. Then, the corona control ring is secured to for example an upper end of a phase-to-phase spacer in such a manner that the depression portion faces upward to reduce an electric field at the end portion of the phase-to-phase spacer, so that corona generation is suppressed.

Moreover, the water discharge holes, each having a racetrack shape, are arranged in the bottom portion. If rain falls, water does not pool in the depression portion and is discharged through the water discharge holes. Therefore, it is possible to eliminate the drawback wherein water pools in the depression portion and is discharged collectively through the water discharge holes each having a small diameter and the water discharged from the water discharge holes becomes a projection shape at which an electric field concentrates. As a result, it is possible to suppress corona discharge.

In the second aspect of the invention, no inner side wall portion is arranged and the outer bottom portion has a width smaller than that of the bottom portion as compared with the first aspect of the invention. Therefore, no depression portion is formed and thus various problems due to corona discharge can be eliminated.

DESCRIPTION OF THE PREFERRED EMBODIMENTS

Figure 3:
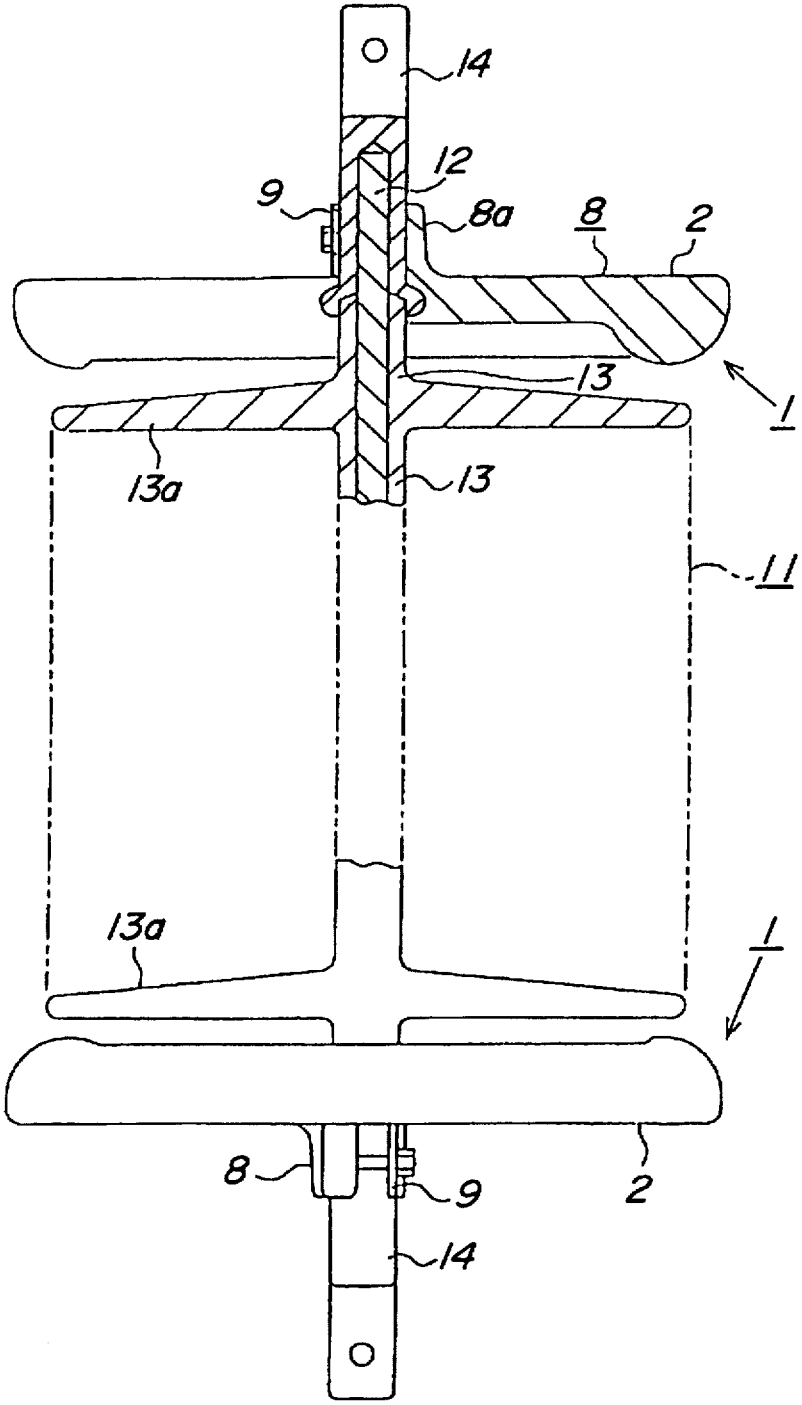
FIG. 3 is a partial front view cross section depicting one embodiment of a phase-to-phase spacer.

Hereinafter, a first embodiment of the present invention will be explained with reference to the drawings. At first, a phase-to-phase spacer 11, to which a corona control ring 1 is installed, is explained. As shown in FIG. 3, the phase-to-phase spacer 11 has an insulation rod 12 made of FRP (fiber reinforced plastic) at its center portion. An insulation coating layer 13 made of rubber is molded around an outer surface of the insulation rod 12. A plurality of insulation sheds 13*a* are integrally formed with the insulation coating layer 13. Metal fittings 14 to connect conductors and phase-to-phase spacers are secured to an upper end portion and a lower end portion of the insulation rod 12 respectively. The corona control rings 1 are arranged around the metal fittings 14. The-phase-to-phase spacer 11 having the construction mentioned above is secured between the upper and the lower conductors (not shown) by means of the metal fittings 14.

Figure 1:
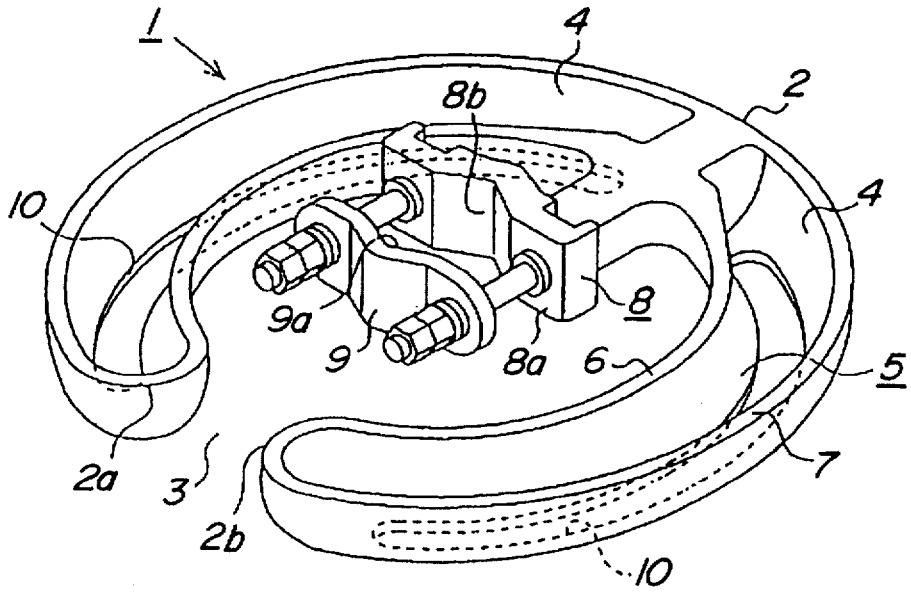
FIG. 1 is a perspective view showing one embodiment of a corona control ring according to the invention.
Figure 2:
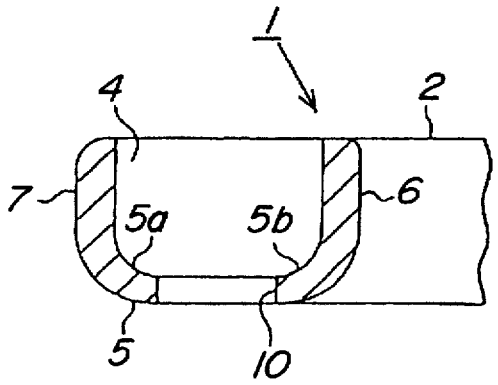
FIG. 2 is a cross sectional view illustrating one embodiment of the corona control ring.

Next, the corona control ring 1 will be explained. As shown in FIGS. 1 to 3, a corona control ring main body 2 made of aluminum or aluminum alloy is formed into a tubular shape by casting, and has an upper opening. Moreover, the corona control ring main body 2 has a cut out portion 3 and has a "C" shape as a whole. Since the cut out portion 3 is provided, the corona control ring 1 can be installed and detached to the phase-to-phase spacer 11 even if the phase-to-phase spacer 11 is secured to the conductors beforehand.

A depression portion 4 is arranged at an upper surface of the corona control ring main body 2. The depression portion 4 is arranged from one open end portion 2*a* to the other open end portion 2*b* except that a base portion of a securing portion 8 mentioned below is formed. Herein, the open end portion means an end portion of the corona control ring main body 2 adjacent the cut out portion 3. Since the depression portion 4 is provided, the weight of the corona control ring 1 can be made light, and a thickness of the corona control ring 1 can be made substantially uniform.

In the embodiment mentioned above, since the depression portion 4 is provided, the corona control ring main body 2 is constructed by a bottom portion 5, and an inner side wall portion 6 and an outer side wall portion 7 respectively arranged at an inner edge portion and an outer edge portion of the bottom portion 5. Outer surfaces arranged from the bottom portion 5 to the inner side wall portion 6 or the outer side wall portion 7 have a curved shape. Open ends of the inner side wall portion 6 and the outer side wall portion 7 are respectively bent outwardly and inwardly, and are continuously connected to the opposed open ends of the outer side wall portion 7 and the inner side wall portion 6 respectively to form open end portions 2*a* and 2*b*. The open end portion 2*a* (2*b*) of the corona control ring main body 2 has a projection shape and one open end portion 2*a* is opposed to the other open end portion 2*b*.

The securing portion 8 is formed integrally with the corona control ring main body 2 such that it extends from the outer side wall portion 7 to a center portion of the corona control ring main body 2 through the depression portion 4. The securing portion 8 has a binding portion 8*a* at its tip portion, and a binding depression portion 8*b* is formed in the securing portion 8 at its center portion. A binding plate 9 coupled with the securing portion 8 has a binding depression portion 9*a* at its center portion. The binding plate 9 is secured to the securing portion 8 by means of screws and nuts such that the binding depression portions 8b and 9*a* are opposed.

In the corona control ring 1 mentioned above, water discharge holes 10 are arranged in the bottom portion 5. That is, one water discharge hole 10 is formed from one open end portion 2*a* to the base portion of the securing portion 8 in the bottom portion 5. The other water discharge hole 10 is formed from the other open end portion 2*b* to the base portion of the securing portion 8. In this manner, two water discharge holes 10 having a racetrack shape are arranged along an extended direction of the corona control ring main body 2. As shown in FIG. 2, since the water discharge holes 10 are arranged in the bottom portion 5, there remains only an inner bottom portion 5*b* and an outer bottom portion 5*a* of the bottom portion 5 having a substantially one-fourth circle shape. Therefore, the bottom portion 5 can be constructed in an extremely weight reduced manner as compared with the conventional corona control ring shown in FIGS. 7 and 8.

As shown in FIG. 3, the corona control rings 1 having the construction mentioned above are secured to an upper end and the lower end of the phase-to-phase spacer 11 such that the metal fittings 14 are arranged between the binding depression portions 8*b* and 9*a* of the securing portions 8 and are fixed by means of screws. In this case, the upper corona ring 1 is secured to the upper metal fitting 14 such that the depression portion 4 is opened upward i.e. in an upward direction in the figures. Moreover, the lower corona ring 1 is secured to the lower metal fitting 14 such that the depression portion 4 is opened downward. The corona rings 1 mentioned above can decrease a concentration of an electric field near the upper end portion and the lower end portion and can suppress the generation of corona discharge.

Since the upper corona ring 1 mentioned above has the depression portion 4 opened upward, water pools in the depression portion 4 if rain falls. However, in the corona ring 1 mentioned above, the water discharge hole 10 arranged in the bottom portion 5 has a larger open area substantially equal to the bottom portion 5. Therefore, the water discharge hole 10 according to the invention has a higher water discharging efficiency than that of the known water discharge hole 27 having a small diameter. In this case, water remaining at the outer bottom portion 5*a* and the inner wall portion 5*b* each having a small area and water adhered to the inner side wall portion 6 and the outer side wall portion 7 and moved downward can be discharged through the water discharge hole 10 without pooling in the depression portion 4. Moreover, a part of the rain falls directly through the opening of the depression portion 4 and the water discharge hole 10 without touching the side wall portions 6 and 7.

As mentioned above, according to the embodiment mentioned above, since the water discharge hole 10 having a large open area is arranged in the bottom portion 5, water is not maintained in the depression portion 4 and can be discharged through the water discharge hole 10 if a rain fall is hard. Therefore, it is possible to eliminate a collective water fall of the water maintained in the depression portion 4, and thus it is possible to suppress the generation of a projection portion of the water discharge hole 10, at which an electric concentrates. As a result, it is possible to increase an operation voltage at which noise due to corona generation reaches a limit level. That is, it is possible to eliminate jamming for television, radio and other signals. Further, since the corona generation voltage can be increased, it is also possible to suppress radiation generation. As mentioned above, various problems due to corona discharge can be prevented.

Moreover, since the water discharge hole 10 has a large opening area in the bottom portion 5, the water maintained in the depression hole 4 can be completely discharged. Therefore, it is possible to eliminate corrosion of the corona control ring main body 2 due to the pooled water. Further, it is possible to make a total weight of the corona ring 1 light.

In the embodiment mentioned above, the corona control rings 1 arranged at the upper end portion and the lower end portion of the phase-to-phase spacer 11 have the same construction because of easy preparation work, easy securing and light weight of the phase-to-phase spacer 11. However, the lower corona control ring 1 has no disadvantages with respect to water pooling in the depression portion 4 mentioned above. Therefore, the lower corona ring 1 may have a different construction i.e. have no water discharge holes 10.

Hereinafter, a second embodiment of the present invention will be explained with reference to the drawings. In the second embodiment mentioned below, portions similar to those of the first embodiment are denoted by the same reference numerals as those of the first embodiment.

Figure 6:
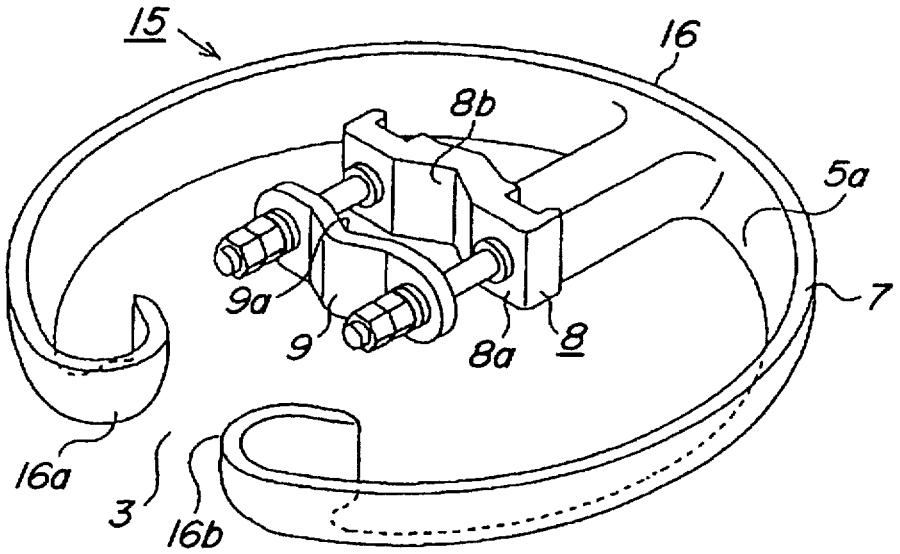
FIG. 6 is a perspective view depicting still another embodiment of the corona control ring according to the invention.
Figure 7:
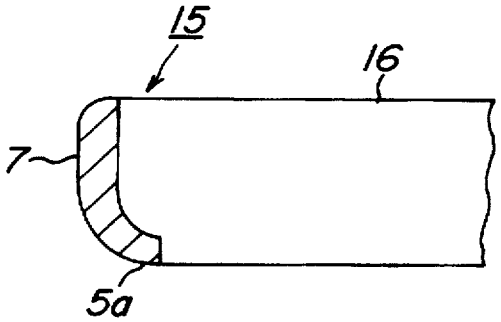
FIG. 7 is a cross sectional view showing the corona control ring of FIG. 6.
Figure 8:
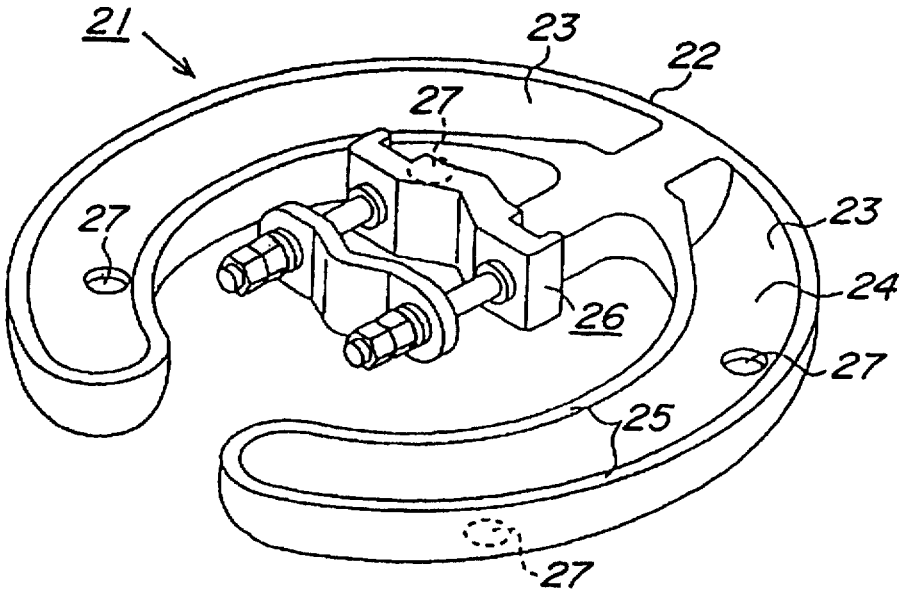
FIG 8 PRIOR ART
FIG. 8 is a perspective view illustrating a prior art corona control ring.
Figure 9:
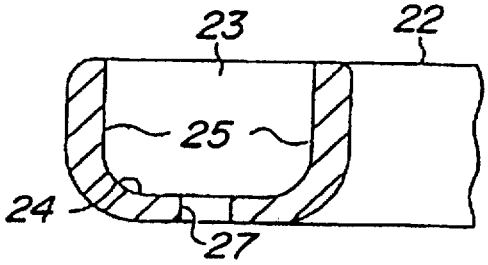
FIG 9 PRIOR ART
FIG. 9 is a cross sectional view showing the corona control ring of FIG. 8.

As shown in FIGS. 6 and 7, a corona control ring main body 16 of a corona control ring 15 according to the second embodiment comprises only the outer bottom portion 5*a* and the outer side wall portion 7 extending from the edge of the outer bottom portion 5*a*. Therefore, the corona control ring main body 15 has a cross sectional shape of substantially one-fourth of a circle. Then, open ends of the outer side wall portions 7 are bent inwardly to form open end portions 16*a* and 16*b* each having a circular projection shape. The open end portions 16*a* and 16*b* are opposed to each other at the cut out portion 3.

In the second embodiment mentioned above, since the corona control ring main body 16 has only the outer bottom portion 5*a* and the outer side wall portion 7, no depression portion 4 of the first embodiment is formed. Therefore, the generation of the projection portion due to water pooling in the depression portion 4 can be preferably prevented, and thus it is possible to suppress the generation of corona discharge even if rain fall is hard.

The present invention is not limited to the embodiments mentioned above, but various modifications mentioned below are possible.

Figure 5:
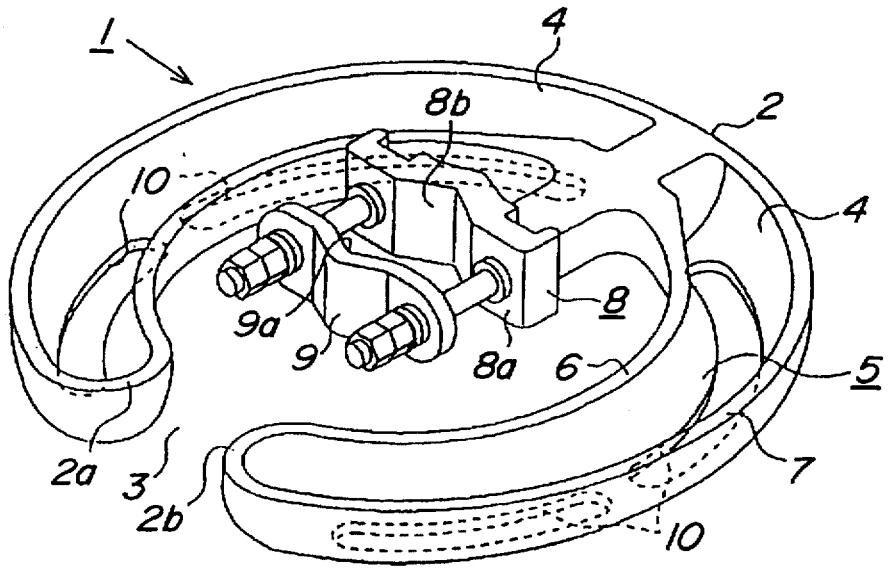
FIG. 5 is a perspective view illustrating still another embodiment of the corona control ring according to the invention.

(1) In the first embodiment, the water discharge hole 10 having a racetrack shape is divided into two pieces at a base of the securing portion 8 as a boundary, but it is possible to divide two water discharge holes 10 respectively into two pieces as shown in FIG. 5. In this manner, a number of water discharge holes 10 can be used. If the number of water discharge holes 10 is increased, the bottom portions remaining between the water discharge holes 10 function to reinforce the corona control ring 4 and thus a decrease of the mechanical strength can be prevented. Moreover, the water discharge holes 10 having the racetrack shape and the water discharge holes 27 having a small diameter may be used together.

Figure 4:
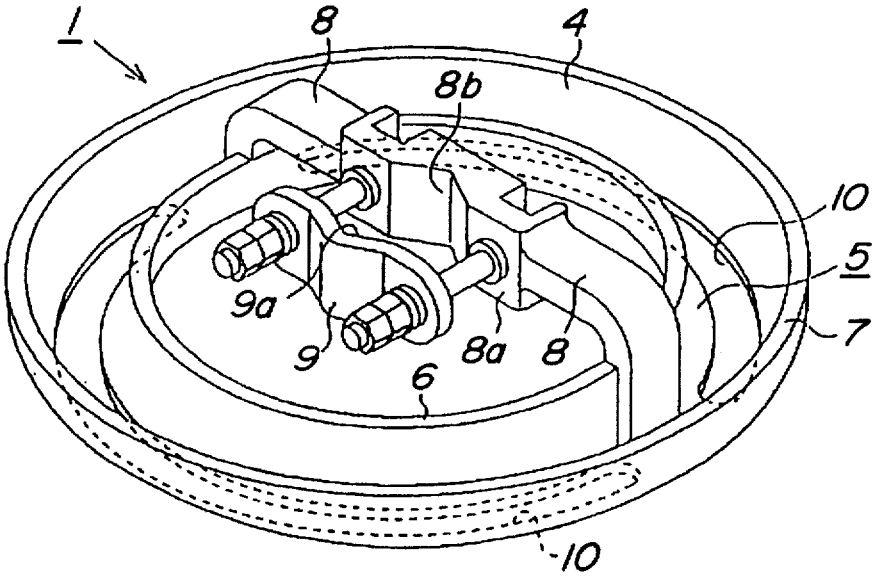
FIG. 4 is a perspective view showing another embodiment of the corona control ring according to the invention.

(2) In the first embodiment, a part of the corona control ring main body 2 having a circular shape is cut out at the cut out portion 30 but it is possible to eliminate the cut out portion 3 as shown in FIG. 4. In this case, the securing portion 8 is connected between the inner side wall portions 6 like a bridge and the binding portion 8*a* is formed at a center of the securing portion 8. In this manner, if no cut out portion 3 is provided, it is possible to suppress the generation of the corona discharge between the open end portions 2*a* and 2*b*. It should be noted that, even in the corona control rings 2*a* and 2*b*, the cut out portion 3 may be closed as mentioned above.

As mentioned above, according to the invention, since the water discharge holes having a racetrack shape are arranged in the bottom portion of the corona control ring main body, water pooled in the depression portion of the corona control ring main body can be discharged rapidly and completely, and thus corona discharge can be preferably prevented even if rain fall is hard. Therefore, various problems due to corona discharge can be eliminated.

What is claimed is:

1. A corona control ring, comprising:

a corona control ring main body having a bottom portion, an inner wall portion and an outer wall portion, said inner and outer wall portions respectively arranged at an inner edge portion and an outer edge portion of said bottom portion; and at least one elongated water discharge hole arranged in said bottom portion along an extended circumferential direction of said corona control ring main body.

2. The corona control ring according to claim 1, wherein said corona control ring main body has a cut out portion.

3. The corona control ring according to claim 2, wherein ends of said outer wall portion adjacent said cut out portion are bent inwardly and ends of said inner wall portion adjacent said cut out portion are bent outwardly to form end portions which are opposed at said cut out portion.

4. The corona control ring according to claim 1, wherein an outer peripheral surface of said corona control ring main body is curved.

5. The corona control ring according to claim 1, further comprising a securing portion affixed to said inner wall portion.

6. The corona control ring according to claim 1, wherein said at least one elongated water discharge hole comprises a plurality of said water discharge holes arranged at a plurality of locations in said bottom portion.

7. A corona control ring, comprising; a corona control ring main body having an outer bottom portion, an outer wall portion arranged at an outer edge portion of said outer bottom portion and an inner edge portion of said outer bottom portion being free from an inner wall portion, wherein a cross section of said outer wall portion of said corona control ring main body is substantially a quarter circle.

8. The corona control ring according to claim 7, further comprising a cut out portion.

9. The corona control ring according to claim 8, wherein ends of said outer wall portion adjacent said cut out portion are bent inwardly to form end portions which are opposed at said cut out portion.

* * * * *